United States Patent [19]

Hoge et al.

[11] Patent Number: 4,748,897

[45] Date of Patent: Jun. 7, 1988

[54] SUBBASE FOR A PNEUMATIC CONTROL ASSEMBLY FOR A PNEUMATIC CYLINDER

[76] Inventors: Ned W. Hoge, 900 Shullo Dr., Akron, Ohio 44313; Dennis L. Bonacorsi, 1282 Congress Lake Rd., Mogadore, Ohio 44260

[21] Appl. No.: 903,600

[22] Filed: Sep. 5, 1986

[51] Int. Cl.[4] ..... F15B 11/08

[52] U.S. Cl. ..... 91/461; 91/462; 91/459; 91/463; 91/464; 251/366; 251/367

[58] Field of Search ..... 91/461, 459, 462, 463, 91/464, 465; 251/367, 366

[56] References Cited

U.S. PATENT DOCUMENTS 3,806,088 4/1974 Stoneman et al. ..... 251/367

4,651,625 3/1987 Hoge ..... 91/463

*Primary Examiner*—Robert E. Garrett

*Assistant Examiner*—Thomas E. Denion

*Attorney, Agent, or Firm*—Reising, Ethington, Barnard, Perry & Milton

[57] ABSTRACT

A base means (12) for directing fluid from a pneumatic control assembly to a number of pneumatic cylinders wherein the base means (12) is remotely mounted from the pneumatic cylinder and the pneumatic control assembly is mounted to the base means (12) and is in fluid communication with the base means (12) through base ports (38,40) which extend completely through the base means (12). The base means includes an upper and lower support surface (28,30), as well as side walls (31,32) and end walls (33,34) extending therebetween, and also includes communication ports (35,36) disposed on the faces of the walls. Flow passeges provide (44,46) fluid communication between the base ports (38,40) and the communication ports (35,36) and delivery means (48) extend between the communication ports (35,36) and cylinder ports located on either side of the piston in a pneumatic cylinder.

8 Claims, 3 Drawing Sheets

SUBBASE FOR A PNEUMATIC CONTROL ASSEMBLY FOR A PNEUMATIC CYLINDER

TECHNICAL FIELD

This invention relates to a remotely mounted subbase for a pneumatic control assembly for a pneumatic cylinder which produces mechanical push-pull forces when compressed air is directed against one side of a piston within a cylinder while air from the opposite side of the piston is allowed to exhaust. Specifically, the invention relates to a subbase for a pneumatic control assembly remotely mounted from a pneumatic cylinder and capable of selectively delivering compressed fluid from the subbase to a piston or to a number of pistons in a number of cylinders and from the pistons to the subbase.

BACKGROUND ART

The charging and exhausting of alternative sides of a piston in an air cylinder is accomplished by a pneumatic control assembly either connected directly to the cylinder ports or remotely mounted from the cylinder. Where complex machinery requires a number of pneumatic operated cylinders to provide mechanical push-pull forces, efficient design of the machine does not always provide enough space for cylinders to be controlled by directly mounted control assemblies. In these situations, the cylinder must be controlled by a separate control assembly remotely mounted from the cylinder. Flexible hoses interconnect the control assemblies with alternative sides of the pistons to provide the required fluid communication necessary to operate the cylinders.

STATEMENT OF INVENTION AND ADVANTAGES

The invention is related to a base means for directing fluid from a control assembly to one or more pneumatic cylinders having a piston movable therein between first and second positions and a rod extending from the piston exteriorly of the cylinder, including first and second cylinder ports therein for communication of fluid to and from opposite sides of the piston for moving the piston and rod between first and second positions. The base means is remotely mounted from the cylinder and comprises an upper support surface for engaging and supporting the first face of a valve body means and a lower support surface oppositely disposed and spaced from the upper support surface. In addition, the base means includes first and second base ports disposed on the upper support surface extending through the base means between the upper and lower support surfaces. First and second side walls and first and second end walls extend between the upper and lower support surfaces to space the upper and lower support surfaces. The base means also includes first communication ports disposed on at least one side of the side walls and second communication ports disposed on at least one side of the end walls. Side flow passages extend from the first communication ports and provide fluid communication between the first communication ports and the first and second base ports. Further, end flow passages extend from the second communication ports and provide fluid communication between the second communication ports and the first and second base ports. The base means is for selectively delivering fluid from the pneumatic control assembly to at least one pneumatic cylinder and from the pneumatic cylinder to the pneumatic control assembly.

The subject invention provides the advantages over the prior art of allowing directly mounted pneumatic control assemblies of the type shown in U.S. Pat. No. 4,651,625 filed by this applicant and entitled "Pneumatic Control Assembly for a Pneumatic Cylinder," to be remotely mounted from the cylinder when machine design parameters dictate this result. Further, the present invention allows the direct mounted pneumatic control assembly to control the charging and exhausting of alternative sides of a plurality of pneumatic cylinders.

FIGURES IN THE DRAWINGS

Other advantages of the present invention will be readily appreciated as the same becomes better understood by reference to the following detailed description when considered in connection with the accompanying drawings wherein.

DETAILED DESCRIPTION OF THE DRAWINGS

Figure 1:
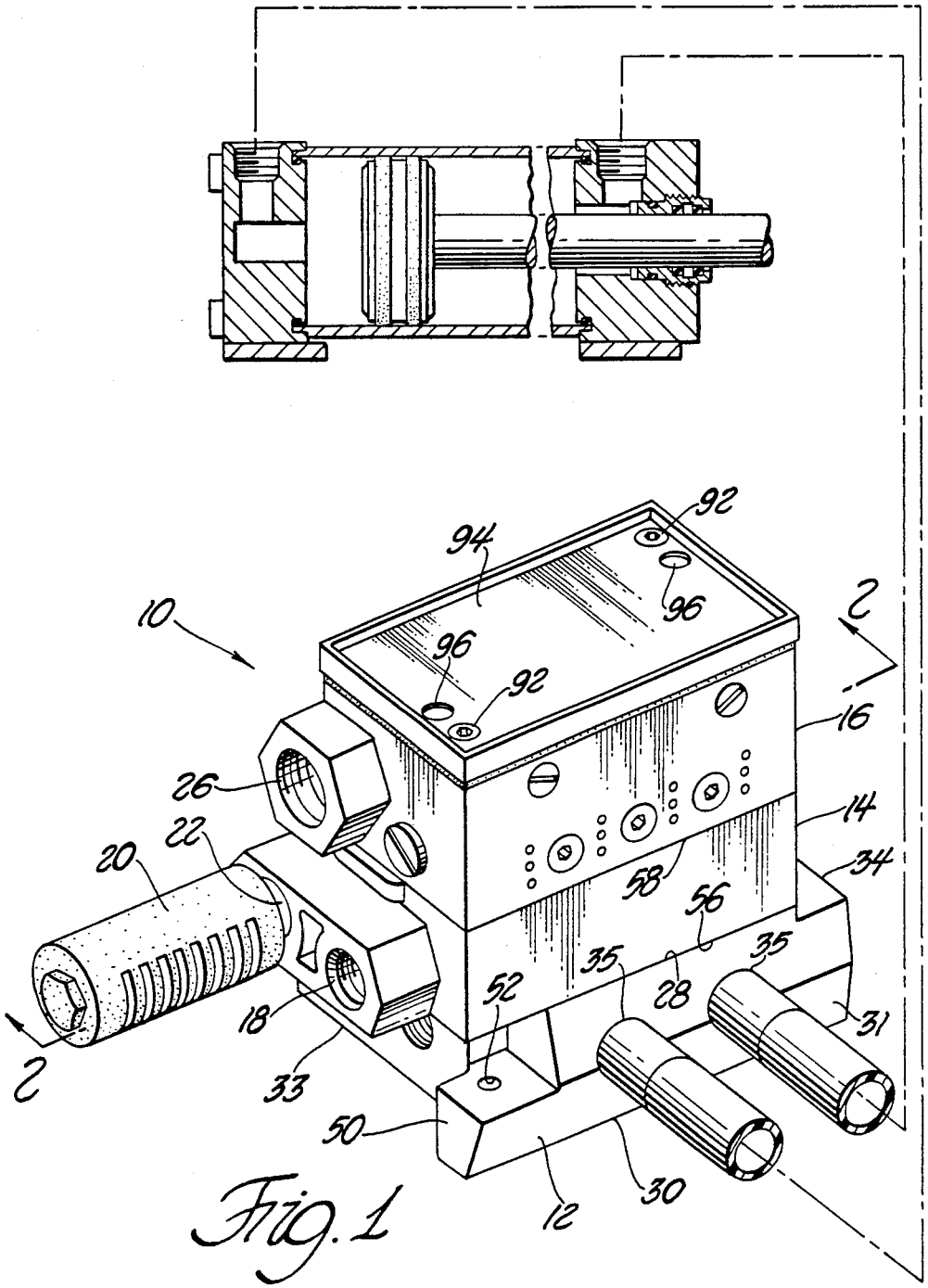
FIG. 1 is a perspective view of a preferred embodiment of the pneumatic control assembly for a pneumatic cylinder remotely mounted on a subbase.

A pneumatic control assembly of the type shown in U.S. Pat. No. 4,651,625 filed by one of the present inventors is shown remotely mounted to a subbase means in FIGS. 1 and 2. The pneumatic control assembly is generally shown at 10 and the subbase means is generally shown at 12.

The control assembly 10 includes a valve body means generally indicated at 14 for directing fluid from a source to the subbase means 12 and for directing fluid from the subase means 12 to an exhaust environment. The valve body means 14 is mounted to the base means 12 and supports a pilot body means 16 which, in turn, is mounted to the valve body 14. The valve body means 14 includes an inlet port 18 for receiving a high-pressure fluid conduit which serves as a source of high-pressure air. The valve body means 14 also includes a muffler 20 threadedly attached to the valve body means 14 at an exhaust port 22.

The pilot body means 16 mounted on the valve body means 14 pilots the operation of the valve body means 14 in response to control signals. The control signals are directed to the pilot body means 16 through an electrical conduit 24 which provides electrical signals to the pilot body means 16. The electrical conduit 24 may be threadedly secured to the pilot body means at an electrical conduit port 26.

The base means 12 includes upper and lower support surfaces 28 and 30, respectively. The upper and lower support surfaces are parallel, oppositely disposed and spaced from each other. Support walls including first and second side walls 31,32 and first and second end walls 33,34 extend between the upper and lower support surfaces 28 and 30 and space the upper and lower support surfaces 28 and 30. The first and second side walls 31,32 are substantially parallel with respect to one another. Similarly, the first and second end walls 33,34 are substantially parallel to one another also. In addition, first side wall 31 and first end wall 33 are disposed substantially perpendicular with respect to each other. Similarly, second side wall 32 and second end wall 34 are disposed substantially perpendicular with respect to one another. Further, the first and second side walls 31,32 and first and second end walls 33,34 are all disposed relative to each other such that the base means 12 is symmetrical. There are first communication ports 35 disposed on at least one of the side walls 31,32 and second communication ports 36 disposed on at least one of the end walls 33,34. Identical first and second base ports 38 and 40, respectively, are located on the upper support surface 28 of the base means 12 and extend completely through the base means 12 between the upper and lower support surfaces to present first and second lower surface openigns 37,39 on the lower surface 30. The base ports 38 and 40 are spaced from each other and include threads 41 disposed interiorly of each base port 38 and 40. There are side flow passages 44 extending between the first communication ports 35 in one of the side walls 31,33 and the first and second base ports 38 and 40. The side flow passages 44 provide fluid communication between the first communication ports 35 and the first and second base ports 38,40. Similarly, end flow passages 46 extend between the second communication ports 36 in one of the end walls 33,34 and the first and second base ports 38,40. The end flow passages 46 also provide fluid communication between the second communication ports 36 and the first and second base ports 38,40. Delivery means, including flexible hosing 48, may be threadedly connected at one end to the first and second communication ports 35,36 in the first and second side walls 31,32, first or second end walls 33,34, respectively, and the first and second lower surface openings 37,39 presented by the first and second base ports 38,40 in the lower support surface 30 of the base means 12. The other ends of the delivery means 48 are connected to the first and second cylinder ports on pneumatic cylinders. The delivery means 48 provides fluid passageways from the base means 12 to the cylinder and from the cylinder to the base means 12. Further, when either the first or second communication ports 35,36 are not utilized, plugs (not shown) may be threadedly secured in the ports to close off these openings.

The base means 12 also includes a plurality of anchor means including anchor tabs 50 disposed oppositely and diagonally with respect to each other and the base means 12 such that the anchor tabs 50 are symmetrical with respect to each other and the base means 12. The anchor tabs 50 are for anchoring the base means 12 and the pneumatic assembly 10 to a support structure. The anchor tabs 50 are rectangular in shape and include mounting holes 52 for receiving a fastener means such as a bolt to facilitate mounting the base means 12 to a fixed support structure. The base means 12 also includes pins 54 which extend from the upper support surface 28 in between the first and second base ports 38 and 40 but opposite one another. The pins 54 serve to guide and orientate the valve body means 14 as it is mounted upon the base means 12.

The valve body means 14 has a first face 56 for engaging the base means 12 about the first and second base ports 38 and 40 therein. The valve body 14 also includes a second face 58 oppositely disposed and spaced from the first face 56 for flush engagement with the surface of the pilot body means 16. The valve body means 14 further includes first and second coupling ports 60 and 62, respectively. The coupling ports 60 and 62 extend completely through the valve body 14 between the first and second faces 56 and 58 thereof. When the valve body means is remotely mounted, a plug 64 is located in the first coupling port 60 and the second coupling port 62 is free to communicate with either the first or the second base ports 38 or 40. The valve body means 14 includes a transfer port 55 in which is disposed a plug 57. The plug 57 is located in the transfer port 55 when the control assembly 10 is employed in conjunction with the base means 12.

The assembly 10 also includes mounting stud means comprising an integral stud member generally indicated at 70. The stud member 70 extends through the second coupling port 62 and may be threadedly connected to either the first or second base ports 38 or 40 for providing the sole mounting force of the valve body means 14 to the base means 12. The stud member 70 in the second coupling port 62 also establishes sealed communication between the valve body means 14 and the base ports 38 or 40 of the base means 12 while allowing the pilot body means 16 to be flush mounted against the second face 58 and the integral mounting stud 70. A seal is disposed in the recesses in the body means 14 about the lower opening of the second coupling port to seal with the upper surface 28 of the base means 12 about the first and second base ports 38 and 40.

Each integral mounting stud member 70 has a circular or annular flange 72 at the first or top end thereof and threads 74 at the second or bottom end thereof for threadedly engaging the base ports 38 or 40. The stud member 70 clamps the valve body means 14 between the flange 72 thereof and either base port 38,40 as the mounting stud 70 is placed in tension between the flange 72 thereof and the threads 74 at the opposite end thereof. The stud member 70 has a central shank portion 76 of lesser diameter than the diameter of the threaded portion 74 and positioned between the threads 74 and the flange 72. The stud 70 also includes a pocket 78 in the lower end thereof and interiorly of the threaded portion 74. Also included are conically or divergently extending passages 80 interconnecting the pocket 78 and the exterior of the shank portion 76. In addition, the stud member 70 includes a cylindrical sealing portion 82 of smaller diameter than the flange 72 and of larger diameter than the shank portion 76 and having an annular seal therein and extending between the flange 72 and the shank portion 76 for sealing engagement with the interior surface of the coupling port 62.

As mentioned above, a sealing plug means 64 may be disposed in either coupling port 60 or 62, but is located in the first coupling port 60 when the pneumatic control assembly 10 is remotely mounted from the pneumatic cylinder. The sealing plug 64 includes a flange 66 at the upper end thereof with a cylindrical sealing surface having seals therein for engaging the interior surface of the coupling port 60 extending below the flange 66 thereof to prevent fluid flow through the coupling port 60. The valve body means 14 has an annular recess in the second face 58 thereof extending about each of the coupling ports 60 and 62 for receiving the flange of either the sealing plug means 64 or the stud member 70 so that the plug means 64 or stud member 70 is prevented from interfering with the flush mounting of the pilot body means 16 against the second surface 58 of the valve body means 14 while they are disposed in the first and second coupling ports 60 and 62, respectively. The stud member 70 has a tool-receiving socket 84 in the end thereof for receiving a tool such as an Allen wrench for threadedly tightening the stud member 70.

The valve body means 14 includes first and second spool valve bores 86 and 88 extending transversely to the coupling ports 60 and 62. The first and second coupling ports 60 and 62 extend through the valve body means 14 on opposite sides of the first spool valve bore 86. Each of the coupling ports 60 and 62 is in fluid communication with the first spool valve bore 86. The spool valve bores 86 and 88 are cylindrical as are the coupling ports 60 and 62 which coupling ports 60 and 62 each extend into and through the first spool valve bore 86 to establish fluid communication therewith. The valve body means 14 also includes a spool valve port 90 on its first face 56 thereof spaced from the second coupling port 62 and in fluid communication with the second spool valve bore 88. Port sealing means 136 is disposed in a recess about the spool valve port 90 in the valve body means 14 to seal with the upper support surface 28 of the base means 12 about either the first or second base ports 38 or 40. Like the second coupling ports 62, the spool valve port 90 may be placed in fluid communication with either the first or second base ports 38 or 40. As such, and because the base means 12 and anchor tabs 50 are symmetrical, the base means 12 is capable of being rotated 180° with respect to the valve body means 14. The mounting holes 52 of the symmetrical anchor tabs 50 will align with any hole in a mounting structure when rotated in 180° increments. This feature facilitates the mounting of the valve body means 14 on the base means 12 and allows the assembler to provide better access to the communication ports 35,36 on the faces of the first and second side walls 31,32, first and second end walls 33,34 and the openings 37,39 presented by the first and second base ports 38,40 on the lower support surface 30 as dictated by each installation's particular space requirements.

The pilot body means 16 has a bottom surface in flush engagement with the second face 58 of the valve body means 14 and is secured thereto by Allen bolts 92. The pilot body means 16 has an upper sealing or electrical cover plate 94 secured thereto by screws 96. The pilot body means 16 includes a pilot shuttle valve assembly including a sleeve member 122 and a pilot shuttle valve 124.

The valve body means 14 includes in its second face 58 thereof recess grooves 98 and 100, respectively. The recess grooves 98 and 100 each provide fluid communication to the opposite ends of the spool bores 86 and 88. More specifically, recess groove 100 provides fluid communication to the far end of spool bore 86 and to the near end of spool bore 88 for applying fluid pressure to the respective ends of either spool valve member 89. Similarly, recess groove 98 provides fluid communication to the far end of spool bore 88 and to the near end of spool bore 86 for applying fluid pressure to the respective ends of either spool valve member 89.

The pilot body means 16 includes passages 112, 114, 116, 118 and 120 extending therethrough with passages 114, 118 and 120 in fluid communication with a passage located on the top of the valve body means 14. This passage (not shown) conveys fluid pressure from the inlet port 18 of the valve body means 14 to the pilot shuttle valve assembly 122 and 124 and from the pilot shuttle valve assembly to opposite ends of the first and second spool valve 89. The passage 114 branches to become passages 118 and 120. The passage 112 communicates with the passage or groove 98 and the passage 116 communicates with the passage or groove 100.

A gasket 126 having aligned holes is disposed between the second face 58 of the valve body means 14 and the lower surface or plate of the pilot body means 16 to prevent fluid leakage from the grooves and passages.

There is also included a pair of electrically operated solenoid valves 128 and 130. The electrically operated solenoid control valve 128 controls the flow of the fluid under pressure from the passage 118 to the passage 110 which, in turn, communicates with the end of the spool member 124 to move the spool member to the right as viewed in FIG. 2. In a similar fashion, the solenoid control valve 130 controls pilot fluid pressure through the passage 120 to the passage 111 at the opposite end of the pilot spool valve member 124 to move it to the left.

As will be appreciated, complex machinery utilizing pneumatic cylinders may require that the controls for the pneumatic cylinder be remotely mounted from the cylinder. In this situation, a pneumatic control assembly 10 is remotely mounted to a subbase means 12 from which pressurized fluid may be communicated to either side of a number of pneumatic cylinders through delivery means 48. Accordingly, the plug 64 is disposed in the first coupling port 60 and the stud member 70 is located in the second coupling port 62. The second coupling port 62 may then be aligned with either the first or second base ports 38 or 40 depending on the specific design parameters, such as space, the location of the cylinders with respect to the pneumatic control assembly and the number of communication ports 35,36 the operator wishes to employ to actuate the pneumatic cylinders. In any case, whichever base port is aligned with the second coupling ports 62, the spool valve port 90 will be aligned with the other base port. The stud 70, inserted in the second coupling port 62, is then threadedly secured to the first base port 38 to hold the valve body means 14 in position to provide sealed fluid communication between the valve body means 14 and the base means 12 through both first and second base ports 38 and 40. The gasket 126 is then placed in engagement with the second face 58 of the valve body means 14 and the pilot valve body 16 is disposed thereover and secured in position by the Allen fastener screws 92 which threadedly engage the valve body means 14. The electrical conduit 24 is then connected to the pilot body means 16 and the source of pressurized air is connected to the inlet port 18 of the valve body means 14.

In response to signals from an operator or electrical control station, the pilot body means 16 directs the fluid from the source, through the valve body means 14. The fluid is alternately charged and exhausted through the second coupling port 62 and the valve spool port 90 into the base means 12 and through the first and second base ports 38 and 40. When fluid is charged through the first base port 38, it may flow through side flow passage 44 and end flow passage 46 to the first communication ports 35 and to the second communication port 36, respectively, or the fluid may flow through the first base port to the opening 37 presented in the lower support surface 30 of the base means 12. From these ports and openings, the fluid will flow though the delivery means 48 and to one side of a number of pneumatic cylinders. At the same time, fluid is exhausted from the other side of the pneumatic cylinders, through the delivery means 48 to the first communication port 35 and second communication ports 36 and the opening 39 presented by the second base port 40 in the lower support surface 30. The fluid will then flow through the side flow passage 44 and end flow passage 46 to the second base port 40 and then to the spool valve port 90 of the valve body means 14. When the pistons of the cylinders are to be actuated in the opposite direction, the pilot body means 16 directs the flow of pressurized fluid through the valve body means 14 such that the flow through the base means 12 is reversed.

In this way, a pneumatic cylinder may be remotely controlled and operated when it is not advantageous to mount the pneumatic control assembly directly to the cylinder.

As will be appreciated, the position and interconnection of the various fluid passages may be altered significantly to accomplish the same function while the remainder of the components remain unchanged.

Figure 2:
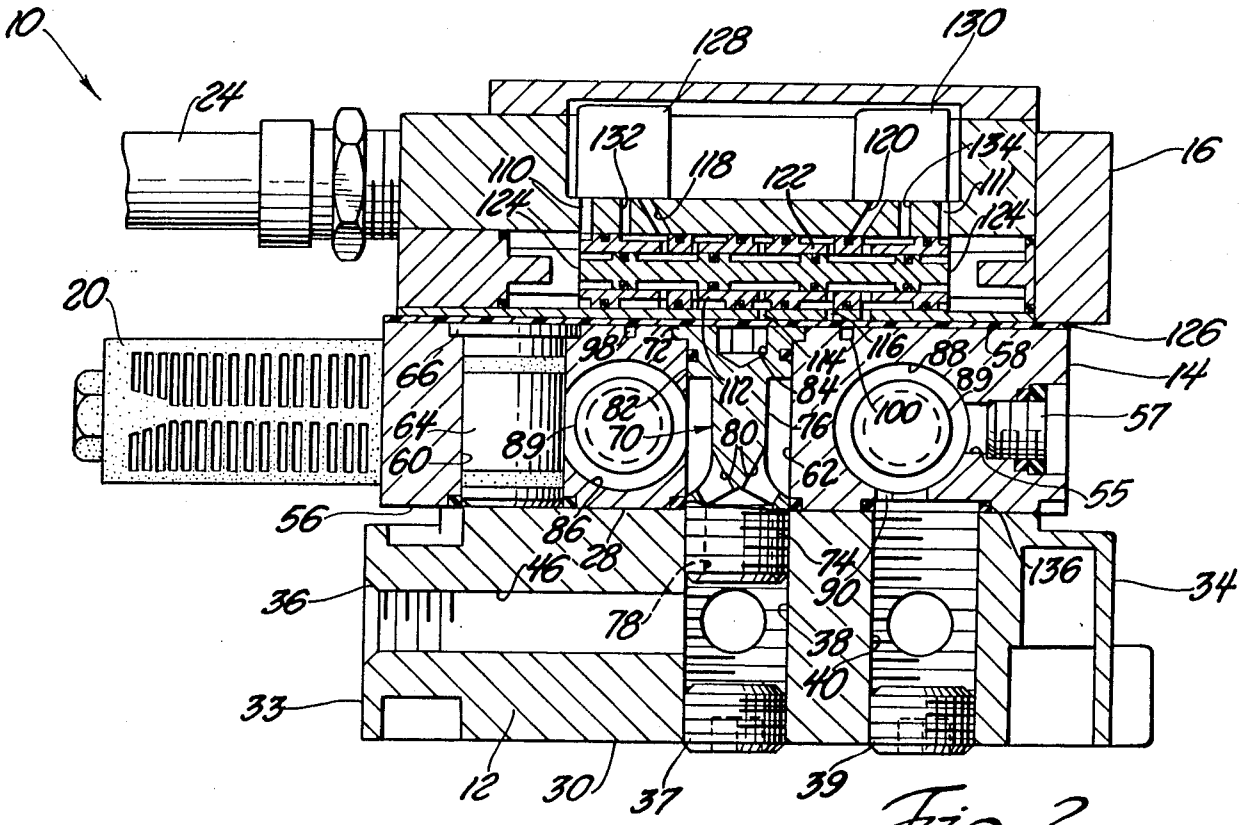
FIG. 2 is a cross section taken substantially along line 2—2 of FIG. 1.
Figure 3:
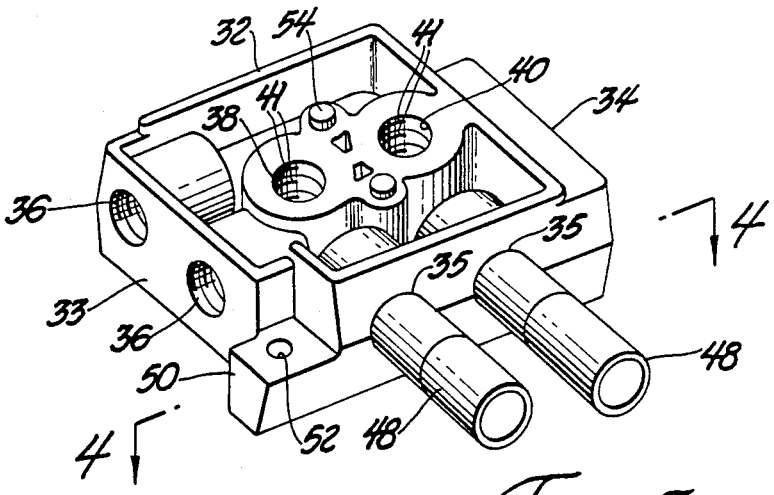
FIG. 3 is a perspective view of the subbase.
Figure 4:
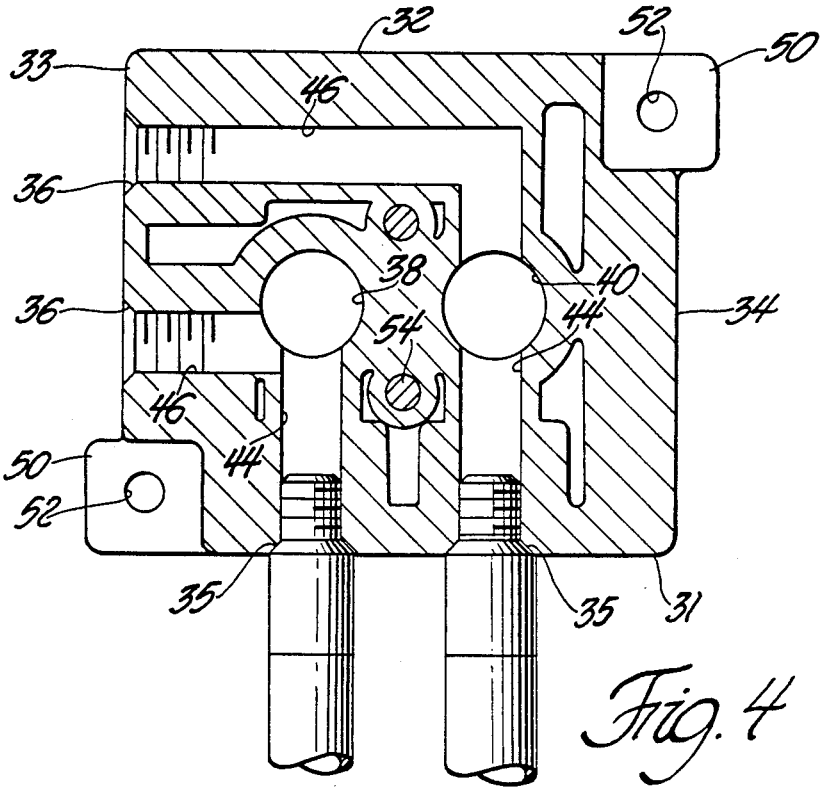
FIG. 4 is a cross-sectional view of the subbase taken substantially along line 4—4 of FIG. 3.

Also, instead of electrical solenoid valves, air pressure may be applied to the appropriate ports to control the pilot valve. It should be noted that when the control assembly 10 is directly mounted to a cylinder, the plug 55 located in transfer port 57 as shown in FIG. 2 is disposed in the spool valve port 90 and the assembly is operated in a manner described in U.S. Ser. No. 612,589.

The invention has been described in an illustrative manner, and it is to be understood that the terminology which has been used is intended to be in the nature of words of description rather than of limitation.

Obviously, many modifications and variations of the present invention are possible in light of the above teachings. It is, therefore, to be understood that within the scope of the appended claims wherein reference numerals are merely for convenience and are not to be in any way limiting, the invention may be practiced otherwise than as specifically described.

What is claimed is:

1. A base means (12) for directing fluid from a control assembly (10) to a number of pneumatic cylinders each having a piston movable therein between first and second positions and a rod extending from the piston exteriorly of the cylinder including first and second cylinder ports therein for communication of fluid to and from opposite sides of the pistons for moving the pistons and rods between first and second positions, said base means (12) comprising; an upper support surface (28) for engaging and supporting the first phase (56) of a valve body means (14) and a lower support surface (30) oppositely disposed and spaced from said upper support surface (28), first and second base ports (38,40) disposed in said upper support surface (28) and extending completely through said base means (12) between said upper and lower support surfaces (28,30), first and second side walls (31,32) and first and second end walls (33,34) extending between said upper and lower support surfaces (28,30) to space said upper and lower support surfaces, first communication ports (35) disposed on at least one side of said side walls (31,32), second communication ports (36) disposed on at least one side of said end walls (33,34) side flow passages (44) extending from said first communication ports (35) in at least one of said side walls (31,32), for providing fluid communication between said first communication ports (35) and said first and second base ports (38,40), and flow passages (46) extending from said second communication ports (36) in one of said end walls (33,34) for providing fluid communication between said second communication ports (36) and said first and second base ports (38,40), either said first or second base ports (38,40) adaptable to provide a fluid communication with one of said second coupling ports (62) in a valve body (14) and a spool valve port (90) in a valve body (14), said first and second base ports (38,40) including threads (41) disposed interiorly of said ports (38,40) for alternately receiving a hollow threaded stud member (70) having threads (74) at the second end thereof and for providing threaded engagement with said stud member (70) and thereby clamping a valve body (14) to said base means (12), said first and second base ports (38,40) being identical and spaced from each other such that either base port (38,40) may receive said stud member (70) and provide fluid communication with one of said second coupling ports (62) and said spool valve port (90), said base means (12) for selectively delivering fluid from the pneumatic control assembly to at least one pneumatic cylinder and from the pneumatic cylinder to said pneumatic control assembly (12).

2. A base means (12) as set forth in claim 1 further characterized by being capable of rotating 180° with respect to said valve body means (14) to facilitate mounting of said valve body means (14) on said base means (12) and to provide better access to said communication ports (35,36) on said faces of said side walls (31,32), said end walls (33,34) and said lower support surface (30).

3. A base means (12) as set forth in claim 2 further characterized by said base means (12) including a plurality of anchor means (50) for anchoring said base member (12) and said pneumatic control assembly (10) to a support structure.

4. A base means (12) as set forth in claim 3 further characterized by said anchor means including anchor tabs (50) disposed oppositely and diagonally with respect to each other and said base means (12) such that said anchor tabs (50) are symmetrical with respect to each other and said base means (12) and further including mounting holes (52) extending through said anchor tabs (50) for receiving fastener means for mounting said base means (12) and said control assembly (10) to a support structure.

5. A base means (12) as set forth in claim 4 further characterized by said first and second side walls (31,32) being substantially parallel with respect to one another and said first and second end walls (33,34) being substantially parallel with respect to one another.

6. A base means (12) as set forth in claim 5 further characterized by said first side walls (31) and said first end wall (33) being substantially perpendicular with respect to one another and said second side wall (32) and said second end wall (34) being substantially perpendicular with respect to one another.

7. A base means (12) as set forth in claim 6, said base means further characterized by said first and second side walls (31,34) and said first and second end walls (32,34) disposed relative to each other such that said base means (12) is symmetrical.

8. A base means (12) as set forth in claim 7 further characterized by said mounting stud means (70) being an integral stud member having a flange (72) at a first end thereof and threads (74) at the second end thereof for threaded engagement with said first or second base ports (38,40) to clamp said valve body means (14) between said flange (72) and said first or second base port (38,40) as said stud member (70) is placed in tension between said flange (72) and said threads (74) thereof and said stud member (70) having a shank portion (76) of lesser diameter than said threads (74) and positioned between said flange (72) and said threads (74) thereof and having a pocket (78) extending into said second end thereof interiorly of said threads (74) and conically extending passages (80) interconnecting said pocket (78) and the exterior of said shank portion (76).

* * * * *